US008672194B2

(12) United States Patent
Moretto

(10) Patent No.: US 8,672,194 B2
(45) Date of Patent: Mar. 18, 2014

(54) HOPPER STRUCTURE

(75) Inventor: Renato Moretto, Padua (IT)

(73) Assignee: Moretto S.p.A., Massanzago (Padova) (IT)

( * ) Notice: Subject to any disclaimer, the term of this patent is extended or adjusted under 35 U.S.C. 154(b) by 254 days.

(21) Appl. No.: 12/994,673

(22) PCT Filed: May 26, 2009

(86) PCT No.: PCT/IB2009/052187

§ 371 (c)(1),
(2), (4) Date: Feb. 8, 2011

(87) PCT Pub. No.: WO2009/147567

PCT Pub. Date: Dec. 10, 2009

(65) Prior Publication Data

US 2011/0163133 A1 Jul. 7, 2011

(30) Foreign Application Priority Data

May 26, 2008 (IT) ..... VR2008A0062

(51) Int. Cl.
*B65D 88/26* (2006.01)

(52) U.S. Cl.
USPC ..... 222/460; 222/461; 222/185.1; 222/567; 222/236; 222/239; 222/411; 366/194

(58) Field of Classification Search
USPC ..... 222/460, 185.1, 461, 567, 236, 239, 222/240, 241, 242, 410, 411; 141/387, 392, 141/332, 341, 342; 366/194, 195, 196, 197, 366/207, 246
See application file for complete search history.

(56) References Cited

U.S. PATENT DOCUMENTS

| | | | | | |
|---|---|---|---|---|---|
| 1,011,219 | A | * | 12/1911 | McKee | 105/247 |
| 1,308,826 | A | * | 7/1919 | Weinrich | 502/427 |
| 1,447,818 | A | * | 3/1923 | Petersen | 52/638 |
| 1,686,077 | A | * | 10/1928 | Evans | 222/1 |
| 1,783,423 | A | * | 12/1930 | Harper | 222/161 |
| 1,898,851 | A | * | 2/1933 | Pieretti | 222/239 |
| 1,901,203 | A | * | 3/1933 | Thompson | 222/224 |
| 1,913,174 | A | * | 6/1933 | Stephenson | 52/234 |
| 2,009,049 | A | * | 7/1935 | Henry | 141/248 |
| 2,180,530 | A | * | 11/1939 | Kassler et al. | 105/253 |
| 2,233,652 | A | * | 3/1941 | Ticknor et al. | 198/535 |
| 2,374,912 | A | * | 5/1945 | Barnes | 366/41 |

(Continued)

FOREIGN PATENT DOCUMENTS

| | | |
|---|---|---|
| DE | 824618 | 12/1951 |
| DE | 9011556 | * 10/1990 |

(Continued)

OTHER PUBLICATIONS

International Search Report for PCT/IB2009/052187.

*Primary Examiner* — Kevin P Shaver
*Assistant Examiner* — Michael J Melaragno
(74) *Attorney, Agent, or Firm* — Dickinson Wright PLLC

(57) ABSTRACT

The present invention regards a hopper structure for containing and treating loose material, which includes a tubular section, upper in use, a lower tapered section equipped with a suitable discharge mouth, a support device for at least the upper tubular section, and a guide device designed to allow the lower section to move between a closed position against the upper section and an open position removed from the upper section.

19 Claims, 7 Drawing Sheets

(56) References Cited

U.S. PATENT DOCUMENTS

| | | | | | |
|---|---|---|---|---|---|
| 2,822,934 | A | * | 2/1958 | Bartelt | 222/240 |
| 2,835,224 | A | * | 5/1958 | Newman | 119/55 |
| 2,862,645 | A | * | 12/1958 | Page et al. | 222/143 |
| 2,867,329 | A | * | 1/1959 | Miller | 210/360.1 |
| 2,950,143 | A | * | 8/1960 | Koranda et al. | 406/145 |
| 2,959,893 | A | * | 11/1960 | Harmos et al. | 47/58.1 R |
| 3,061,063 | A | * | 10/1962 | Rutten | 193/17 |
| 3,124,229 | A | * | 3/1964 | Rutten | 193/2 R |
| 3,169,620 | A | * | 2/1965 | Patz | 193/2 R |
| 3,257,040 | A | * | 6/1966 | Dumbaugh et al. | 222/161 |
| 3,435,993 | A | * | 4/1969 | Hunkel | 222/195 |
| 3,455,475 | A | * | 7/1969 | Suteau | 414/787 |
| 3,899,980 | A | * | 8/1975 | Florig | 105/299 |
| 3,937,522 | A | * | 2/1976 | Korn et al. | 406/135 |
| 3,997,089 | A | * | 12/1976 | Clarke et al. | 222/545 |
| 4,057,152 | A | * | 11/1977 | Weaver | 414/310 |
| 4,206,571 | A | * | 6/1980 | Kramer et al. | 49/340 |
| 4,334,633 | A | * | 6/1982 | Piegza | 49/199 |
| 4,382,498 | A | * | 5/1983 | Glendinning | 193/34 |
| 4,423,831 | A | * | 1/1984 | Sipley | 222/181.3 |
| 4,426,018 | A | * | 1/1984 | Ward | 222/1 |
| 4,430,002 | A | * | 2/1984 | Dongelmans | 366/139 |
| 4,436,458 | A | * | 3/1984 | Wisdom et al. | 406/135 |
| 4,518,095 | A | * | 5/1985 | Engwert | 220/260 |
| 4,669,628 | A | * | 6/1987 | Hatta | 220/211 |
| 4,702,364 | A | * | 10/1987 | Johanneck | 193/22 |
| 5,799,825 | A | * | 9/1998 | Dillman | 222/1 |
| 6,578,743 | B1 | * | 6/2003 | Kokeisl | 222/506 |
| 6,789,357 | B1 | * | 9/2004 | McCullough | 49/386 |

FOREIGN PATENT DOCUMENTS

| | | | | | |
|---|---|---|---|---|---|
| DE | 4318097 | A1 | * | 12/1994 | B65D 90/52 |
| DE | 9416198 | | * | 2/1995 | |
| DE | 10149088 | A1 | * | 4/2003 | F23G 5/02 |
| EP | 1020372 | A2 | * | 7/2000 | B65D 88/70 |
| EP | 1295814 | A1 | * | 3/2003 | B65D 88/70 |
| FR | 517161 | | | 4/1921 | |
| GB | 2101102 | | | 1/1983 | |
| WO | WO 9418029 | A1 | * | 8/1994 | B60P 3/22 |
| WO | 03089346 | | | 10/2003 | |

* cited by examiner

HOPPER STRUCTURE

CLAIM FOR PRIORITY

This application is a national stage application under 35 USC 371 of PCT/IB2009/052187, filed May 26, 2009, which claims the benefit of priority to VR2008A000062, filed May 26, 2008, the entire contents of which are hereby incorporated by reference.

TECHNICAL FIELD OF THE INVENTION

The present invention regards a hopper structure for containing and treating loose material, and in particular synthetic granular material.

BACKGROUND OF THE INVENTION

With the term "hopper" in the present description and in the claims, it is meant any type of tubular container, both open and closed at the top (in this case, also known as "silo"), having a variously configured constant cross-section, e.g. circular, square, or rectangular, terminating with a tapered lower section equipped with a suitable discharge mouth, generally controlled by a suitable discharge valve. A hopper, as is known, is meant to be normally loaded with granular material at an upper section thereof; possibly, after having undergone a type of treatment, such as heat or aeration treatment, the material is then discharged through the discharge mouth. As is known, in recycling or transforming many granular plastic materials into manufactured articles, one of the most important treatments consists of the crystallization process, to which the granular polymer material must be subjected.

The granular material to be treated has semi-crystalline structure, i.e. characterized by crystalline zones with macromolecules arranged in an ordered manner with respect to the others, forming a so-called "long-range order", and by amorphous zones comprising macromolecules arranged in a disordered manner and thus lacking long-range order.

Generally, it is possible to obtain the crystallization of a polymer when the following conditions are met. First, the polymer must have its own polymer chains at least partly ordered according to specific composition and configuration parameters: i.e. it must be equipped with sufficiently long, ordered chain segments. Furthermore, the crystallization process must be feasible both from a thermodynamic and kinematic standpoint. In other words, a sufficiently long time must be provided for the rearranging of the disordered structure of the polymer chains, such a rearranging occurring by translation of its chain lengths until they have an ordered configuration in space.

In order to induce crystallization of amorphous polymer material, it is necessary to provide energy to the material in the form of heat, using a crystallizer apparatus comprising a top-closed hopper or silo. In practice, the amorphous polymer material in granule form is first loaded at the upper part of the hopper through a loading mouth, and then heated by means of hot air insufflation at a lower zone of the hopper to a temperature greater than the glass translation temperature $T_9$, but less than its melting temperature $T_m$.

The glass transition temperature $T_9$ is defined as the temperature beyond which the amorphous polymers gradually pass from a solid state to a so-called "rubbery" state, in which the spatial arrangement of the polymer chain segments (comprising 30-50 atoms, according to the most reliable studies) can vary.

Advantageously, the hopper of a crystallizer is equipped with a mounted for rotation and extending along the longitudinal axis of the hopper for much of its length, on which horizontal blades are fit or fixed. Such blades are suitably spaced from each other in a vertical sense, thereby acting as stirring blades for the granular material being treated. For such purpose, at the top of the hopper or silo, a gearmotor group is provided for, intended to actuate the rotatable shaft and thus the blades. The stirring action of the blades maintains the crystal "suspension" that forms during the crystallization process in a homogeneous suspension, so as to avoid the formation of agglomerates, with consequent formation of undesired lumps in the granular material.

After the specific time for treating the granular material has passed, the crystallization process is completed and the granular polymer material in the hopper thus has an ordered structure. The material can then be cooled before it is discharged through the discharge valve.

During the granular polymer crystallization process, it may occur that, by mistake, the granular material loaded in the hopper is brought to an overly high temperature, causing its melting. The melted material must be immediately removed from the hopper or silo before it solidifies. It is thus quite necessary for an operator to have a quick and easy access inside the hopper, through which he can easily carry out cleaning and material removal operations.

At the state of the art, small-capacity hoppers have already been proposed (with max 50-100 It. capacity), closed at the top and comprising a lower tapered section, equipped with discharge mouth controlled by a suitable valve, supported by a support framework and hinged to an upper tubular section, such that the latter can be angularly displaceable by the operator's hand between a work position, in which it is found mating on the vertical of the lower section, and an open position, in which it is angularly removed (overturned) from the lower section, thereby allowing an easy access. The upper tubular section results manually overturnable with respect to the lower tapered section and, if necessary, an operator could thus easily access the hopper interior for maintenance and cleaning operations.

Nevertheless, this type of hopper cannot be employed for containing and/or treating large quantities of material (>100 It) since the size and weight of the upper section of the hopper would not allow the operator to manually open and close the hopper itself. Furthermore, in the case, for example, of crystallizer hoppers or dehumidification hoppers, the overturning of the upper section of the hopper with respect to the lower tapered section would be impossible or in any case severely hampered by the presence of permanent connections to feed ducts of granular material, hot air, etc. which would have to be previously disconnected from the hopper before its opening. This would lead, furthermore, to long operation dead times for the trained personnel.

Document DE-90 11 556 discloses a silo for loose material having an upper tubular section connected to a lower section provided with a discharging mouth. The lower section comprises an upper portion of substantially hemispherical configuration connected to the upper section of the silo, and delimiting a substantially oval opening, and a lower tapered portion, in which the discharging mouth is formed, and which is hinged to said upper hemispherical portion through suitable hinging means. With such a configuration, the lower tapered portion of the lower section of the silo can be angularly displaced from a closure position, in which it closes the oval opening of the substantially hemispherical upper portion, and an open position in which it is displaced from the oval opening to give access to the inside of the silo.

Document DE-94 16 198 teaches connected means designed to connect the discharging mouth of a silo to ducts and pipelines having cross section different from that of the discharging mouth. The connecting means are hinged to the lower tapered portion of the silo.

The silos described in the above identified documents do not provide an easy access to the inside thereof.

SUMMARY OF THE INVENTION

One embodiment of the present invention is to provide a hopper or silo structure for heat-treating synthetic granular materials loaded therein which is structured so as to allow an operator an easy and quick access to the hopper interior for carrying out maintenance operations.

Another object of the present invention is to provide a newly-conceived hopper structure for heat-treating synthetic granular material which allows the automatic moving away-approaching.

Another object of the present invention is to provide a hopper structure that is easy to produce at competitive costs.

These and other objects which will be clearer below are achieved by a hopper structure for heat-treating synthetic granular material, which comprises an upper, in use, tubular section, a lower tapered section equipped with a discharge mouth, and removably connectable to said upper tubular section, support means for at least said upper tubular section, and guide means supported by said support means at the lower end of said upper tubular section, and designed to guide said lower tapered section while moving between a closure position against said upper tubular section and an open position away from said upper tubular section.

BRIEF DESCRIPTION OF THE DRAWINGS

Further aspects and advantages of the present invention will better appear from the following detailed description of a number of currently preferred embodiments, illustrated only by way of non-limiting examples in the accompanying drawings, in which.

In the drawings, equivalent parts or components are marked with the same reference numerals.

DETAILED DESCRIPTION OF THE INVENTION

Figure 1A:
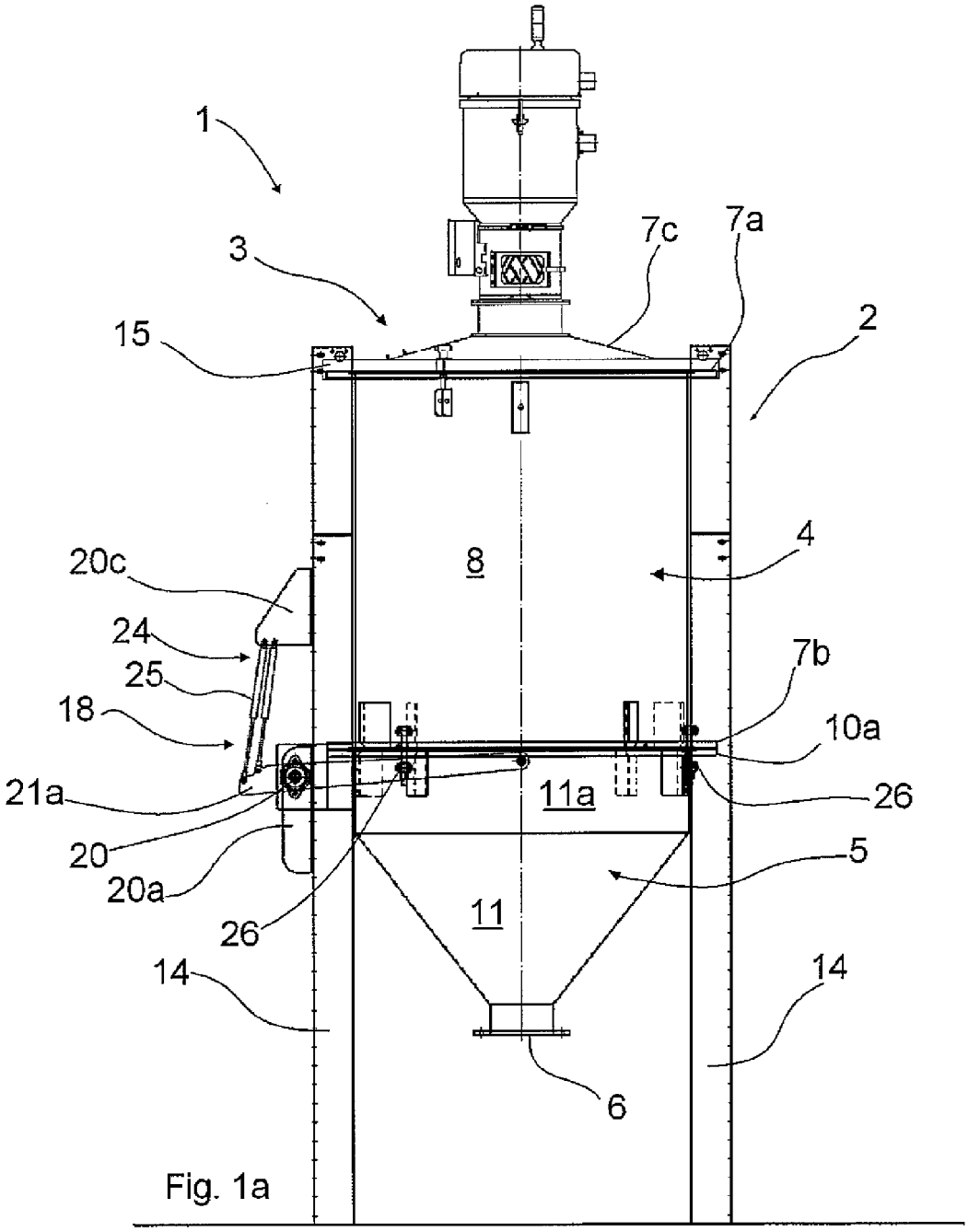
FIGS. 1*a* and 1*b* illustrate two side views with parts in transparency of a first embodiment of a hopper structure according to the present invention in a closed and open position, respectively.
Figure 1B:
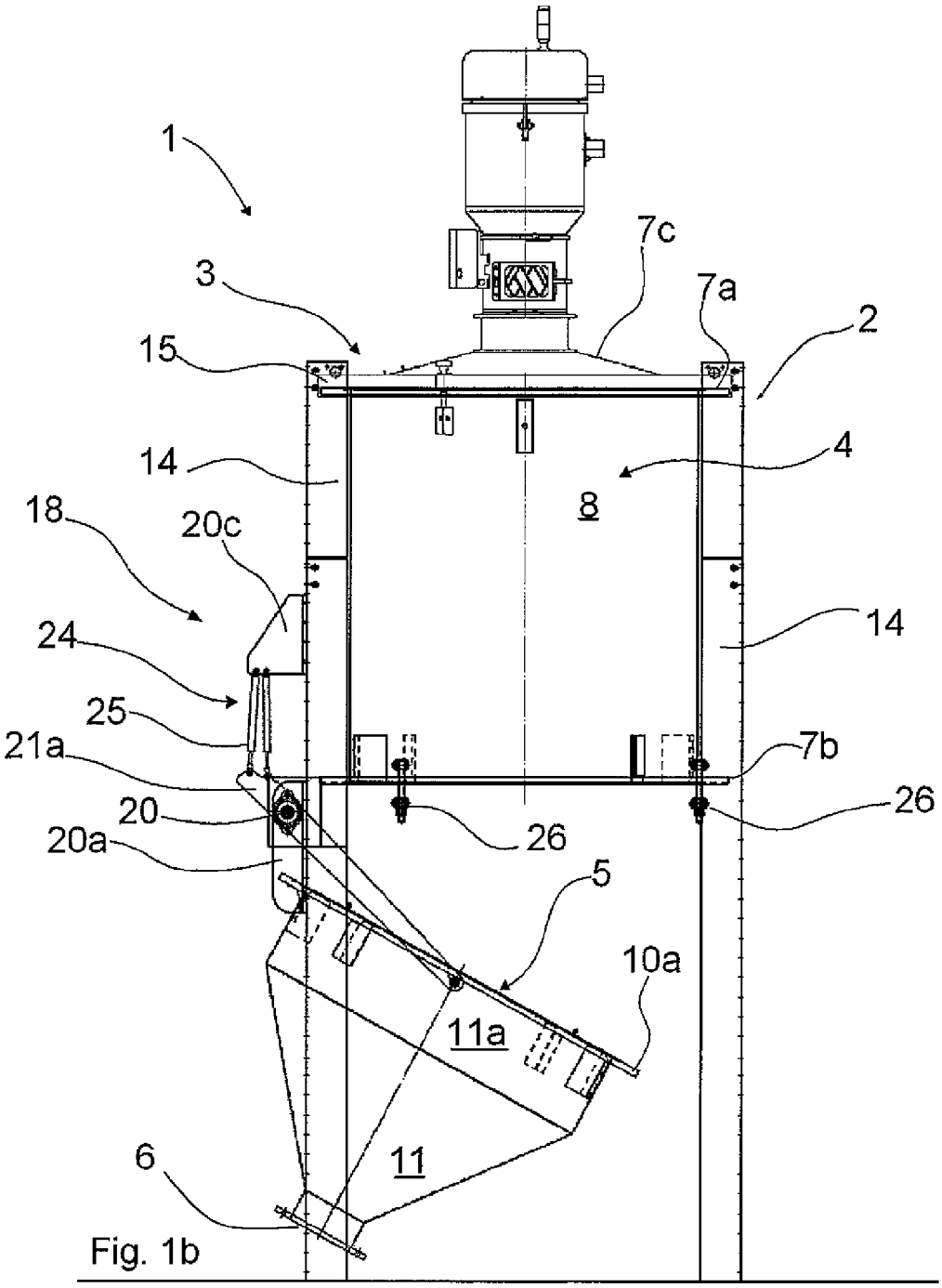
Figure 1C:
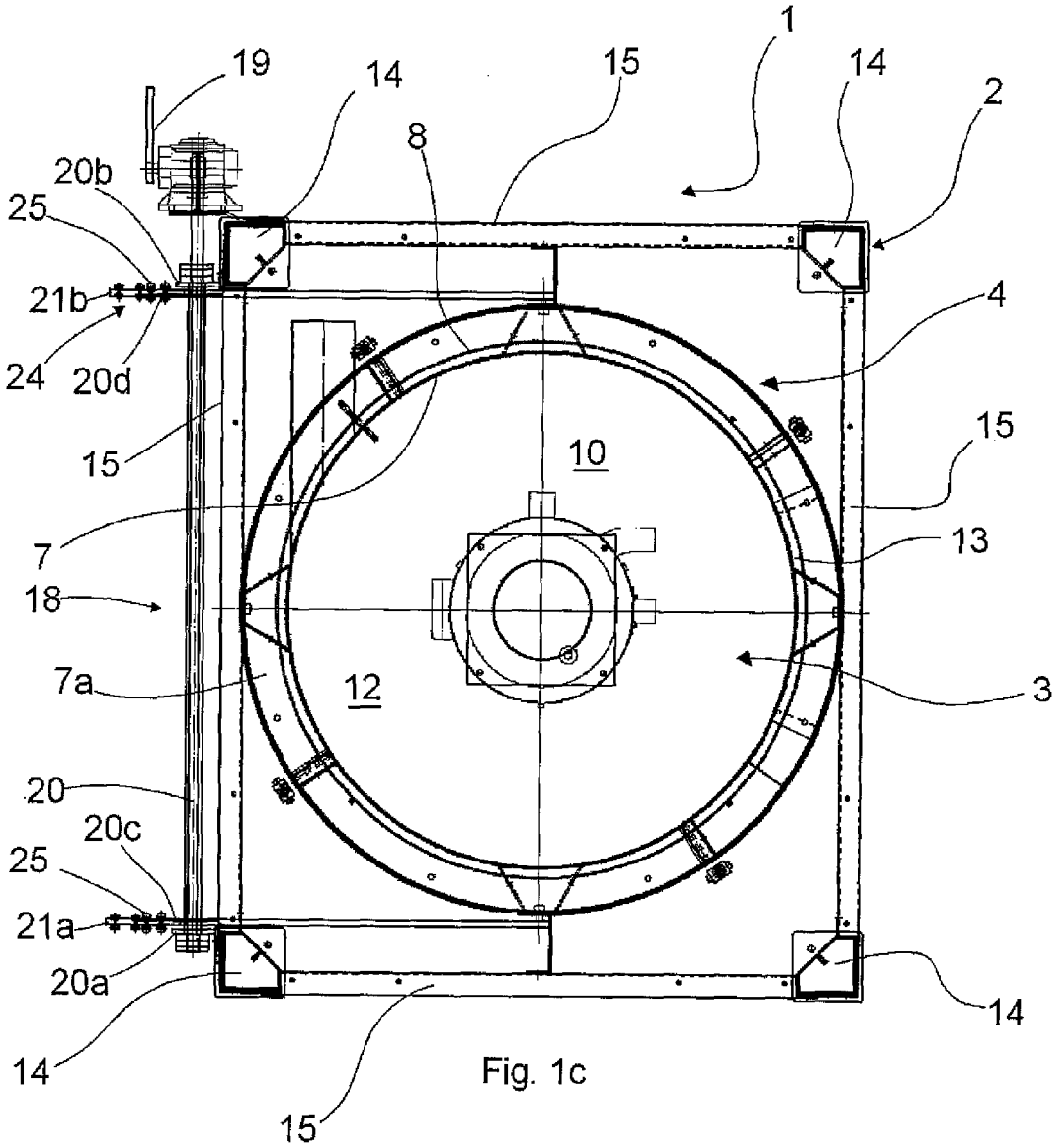
FIG. 1*c* illustrates a plan view with parts in transparency of the hopper of FIG. 1*a;*

First, with reference to FIGS. 1*a*, 1*b* and 1*c*, it will be noted that a hopper structure 1 according to a first embodiment of the present invention comprises support means, typically a support framework 2 for a hopper 3 comprising a tubular section 4, upper in use, and a tapered section, lower in use and terminating at its lower end with a discharge mouth or opening 6.

The upper tubular section 4 comprises an internal metal wall 7 fixed to the support framework 2, e.g. by means of brackets or U-bolts 9. If desired, an external coating jacket 8 can be provided around the internal wall 7. Both the internal wall 7 and the jacket 8 have, for example, circular cross-section, the internal wall preferably having upper 7*a* and lower 7*b* flanged edges. On the top, the upper tubular section 4 is closed by a cover 7*c*, preferably metal, in which a load mouth or opening is formed (not shown in the drawings) for the loading of a granular polymer material.

The tapered section 5, lower in use, comprises an internal wall 10, preferably made of the same material of the internal wall 7, and, if desired, an external jacket 11, preferably made of the same material as the external jacket 8. The lower tapered section 5 can have a substantially frustoconical configuration with maximum diameter corresponding with the diameter of the internal wall of the upper section 4, and is preferably equipped, at least with regard to its external jacket, with a non-tapered tubular section 11*a*, typically cylindrical, mating with the upper section 4. Preferably, the edge, upper in use, of the lower section 5 is flanged at 10*a*, at least at its internal wall 10.

The upper 4 and lower 5 sections are removably connected with each other, as will be described below, for the mutual approaching in vertical alignment, so as to delimit a containment or treatment chamber 12 for the granular polymer material. If the two sections, upper 4 and lower 5, of the hopper are equipped with external coating jacket (8 and 11), the annular gap delimited between the external jacket and the internal walls (7 and 10) can advantageously receive a suitable insulating material 13, e.g. glass wool, mineral wool, etc. set for thermally insulating the treatment chamber 12 from the outside environment.

Regarding the support framework 2: this comprises three or four uprights mounted parallel to each other, e.g. comprising section bars, box elements or tube elements 14; preferably, these are appropriately stiffened and fixed to each other at one or more levels by means of crossbars 15, so as to delimit an area within which the hopper 3 is supported at a predetermined height above the ground.

The framework 2 further supports, e.g. at the lower flanged edge 7*b* of the upper tubular section 4 of the hopper, guide means 18 suitable for allowing the opening and closing of the hopper 3, i.e. the moving away and approaching of the lower section 5 with respect to the upper section 4.

Such guide means 18 can be both manual and automatic. They are designed to allow the lower section 5 of the hopper 3 to carry out a movement, e.g. translational or rotary around at least one rotation axis (either a substantially horizontal or vertical axis), or a rototranslational movement, and guide it along such movement.

The guide means 18 illustrated in FIGS. 1*a* to 1*c* allow a rotary movement (angular travel) around a substantially horizontal axis, and for this purpose they comprise a horizontal pin comprising a transverse shaft 20 with prismatic (preferably hexagonal or square) cross-section, which is supported for rotation on two suitable brackets 20*a* and 20*b* welded or otherwise fixed to a respective upright 14 of the framework 2. The shaft also acts as an actuation member, as will be explained below. At each of the two uprights bearing the brackets 20*a* and 20*b*, a respective lever arm is provided, 21*a* and 21*b* respectively, fit in an intermediate section thereof on a respective end of the shaft 20 and, therefore, rigid in rotation therewith. Each lever arm 21*a* and 21*b* is articulated or fixed, e.g. by means of a bolt, preferably at an upper zone, and more preferably at diametrically-opposed zones of the lower section 5 of the hopper 3.

Preferably, the lever arms 21*a* and 21*b* are secured to the internal wall 10 of the lower section 5 of the hopper, e.g. by means of a respective bolt 9 which crosses through the external jacket 11 and the insulating material 13. The shaft 20 which acts as an actuation or drive member of the motion for the lever arms 21*a* and 21*b* can in turn be manually actuated, e.g. by a crank 19 and a reduction gear, or automatically actuated, e.g. by a gearmotor group or a linear actuator with the interposition of a linear-to-circular motion transformer of any suitable type. Furthermore, it will be noted that an angular displacement of the drive shaft 20 will cause a corresponding angular displacement of the lever aims 21*a* and 21*b* and consequently the angular moving away movement of the lower section 5 from the upper section 4 (FIG. 1*b*), until the lower tapered section 5 from its closed position has moved into completely open position, roughly underneath the guide means 18.

If the lever aims 21*a* and 21*b* are secured to the lower section 5, the latter, once it has reached its open position, will have its own longitudinal axis rotated through the same angle with respect to the vertical as the lever arms. On the contrary, if the lever arms 21*a* and 21*b* are articulated to the lower section 5, the latter—once it has reached its open position—will have a substantially vertical longitudinal axis.

Once the lower section 5 has reached its own open position, the zone beneath the upper section 4 will be (nearly completely) cleared and thus will be easily accessible by an operator, who will be able to carry out maintenance or repair operations.

As an alternative to the above-described configuration, the guide means 18 can comprise any other suitable articulation means, particularly between the flanged edges, 7*b* and 10*a* respectively, of the upper 4 and lower 5 sections of the hopper, as will be further described below.

Advantageously, the guide means 18 comprise resilient load means 24, e.g. two or more pairs of gas springs 25, for stabilizing the moving away-approaching movement of the tapered lower section 5 with respect to the upper section 4, in particular for damping possible undesired oscillations and/or vibrations. Typically, each gas pair 25 has one end thereof constrained, e.g. articulated, to the free end of the respective lever arm 21*a* and 21*b* and the other end thereof constrained (articulated) to a suitable bracket 20*c* or 20*d* welded or otherwise fixed to its respective upright.

It will also be noted that the hopper structure according to the present invention advantageously comprises elements 26 for removably locking in its closed position the lower tapered section 5 against the upper tubular section 4. Such locking elements 26 comprise, for example, one or more lever or screw clamps angularly spaced along the edges: along the upper edge of the lower section 5 and along the lower edge of the upper section 4. If desired, the locking elements 26 comprise bolts that can be inserted into, and disconnected from the flanged edges 7*b* and 10*a*.

Figure 2A:
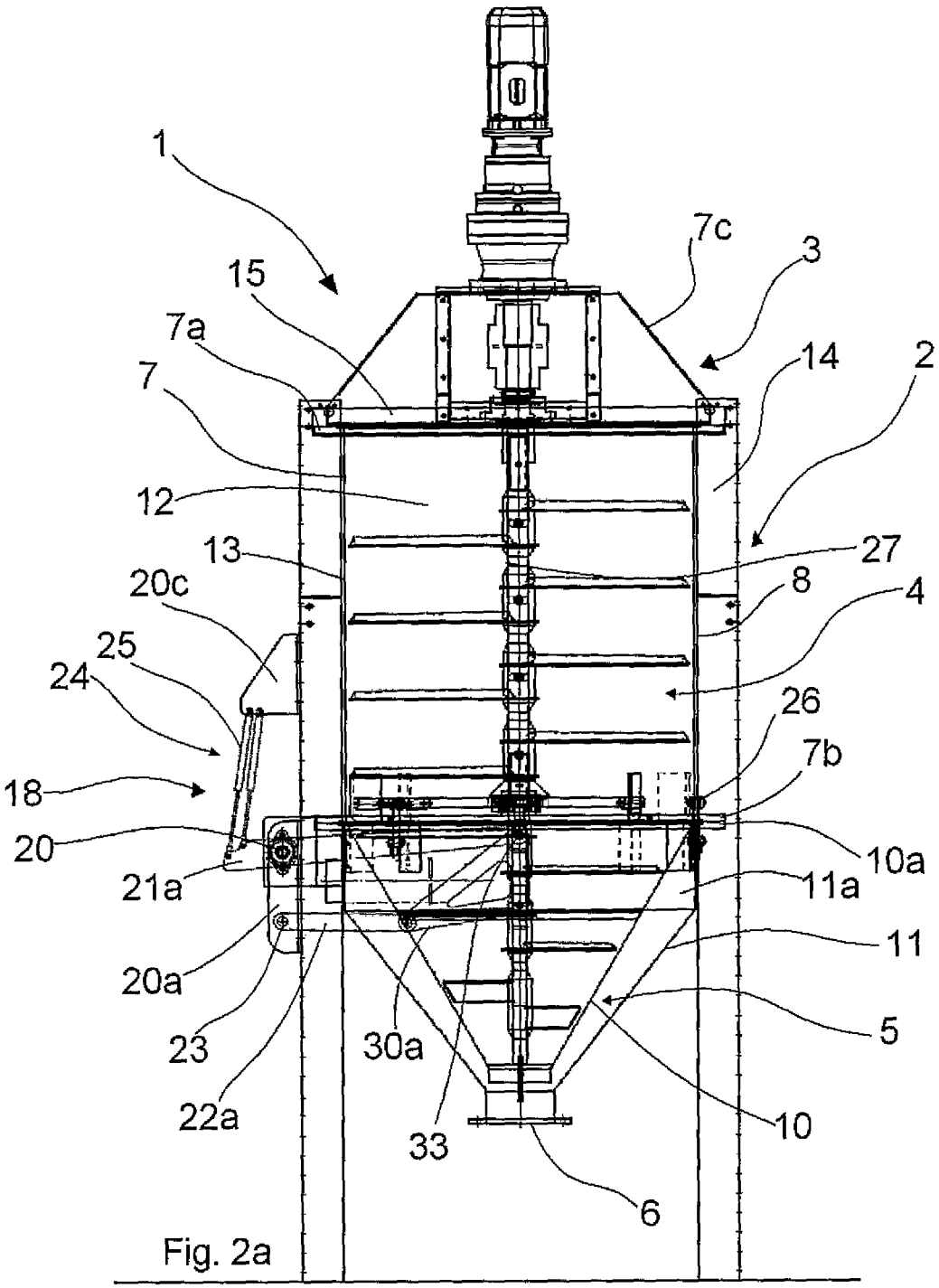
FIGS. 2*a* and 2*b* each show a side view with parts in transparency of a second embodiment of a hopper structure according to the present invention in a closed or open position, respectively, employed for the crystallization of granular polymer material and equipped with shaft with stirring blades for the material loaded into the hopper.
Figure 2B:
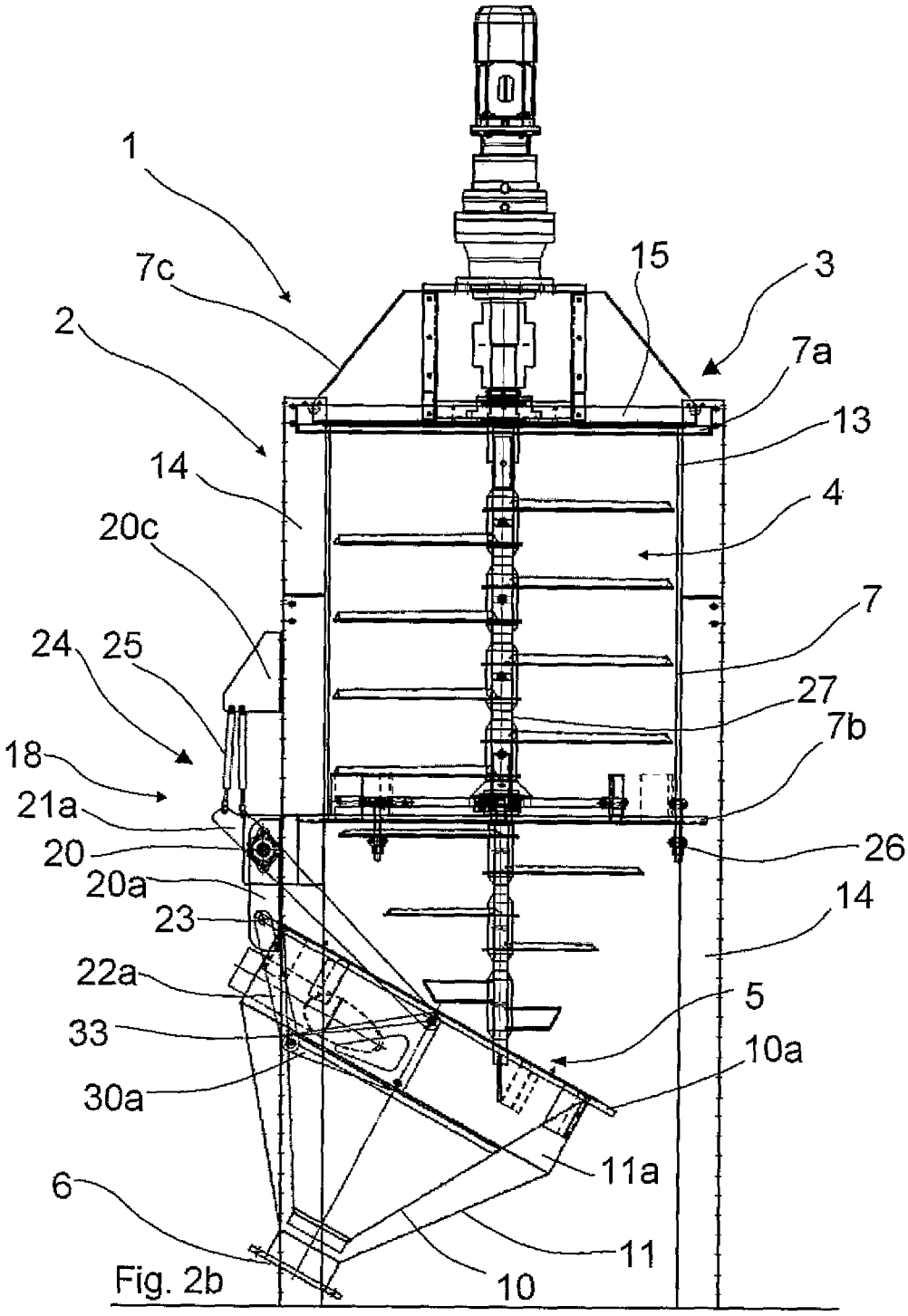
Figure 2C:
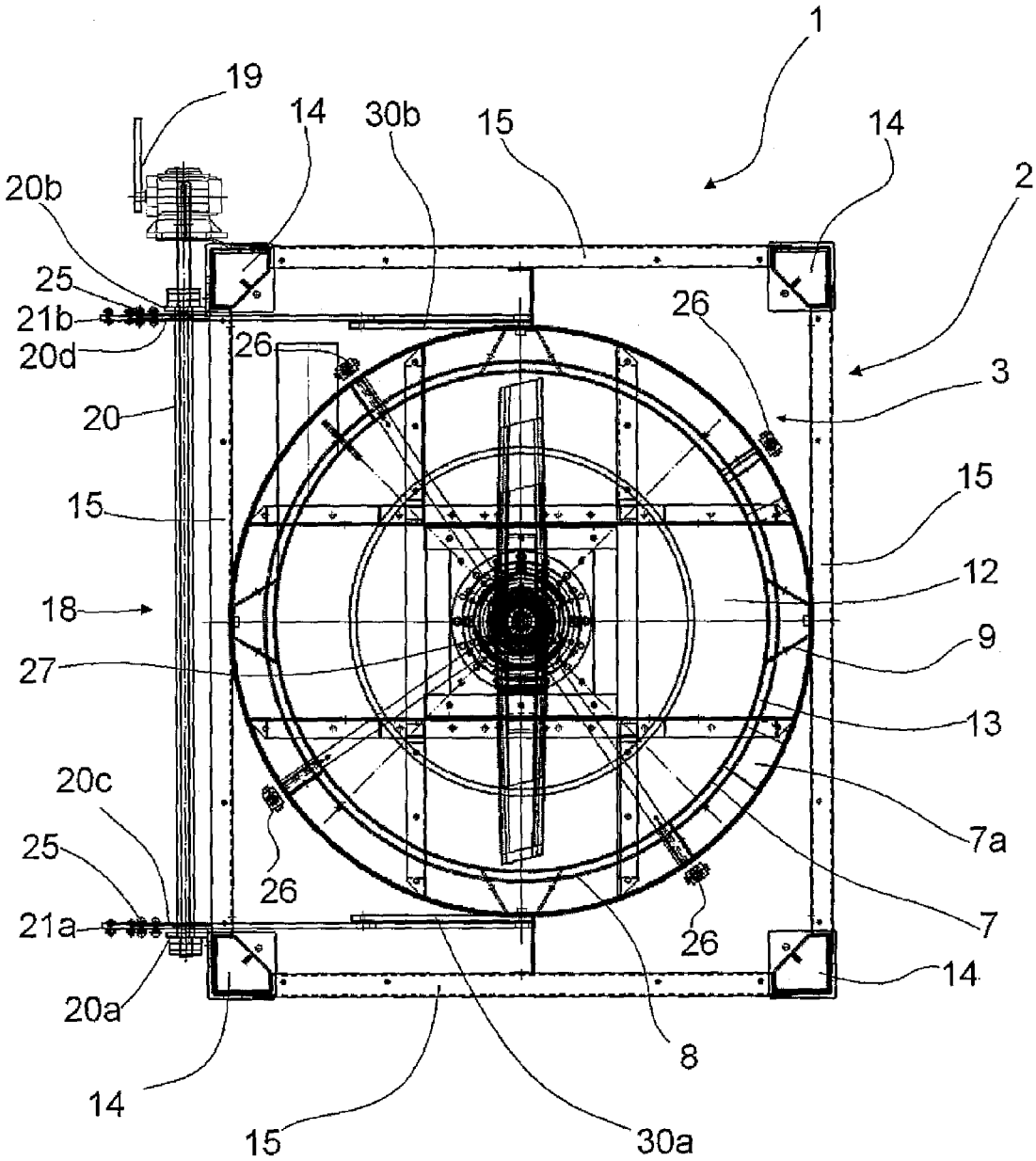
FIG. 2*c* is a plan view with parts in transparency of the hopper of FIG. 2*a*, in which the stirring blades are illustrated superimposed and rotated through 90° with respect to those of FIG. 2*a*.

The embodiment illustrated in FIGS. 2*a* to 2*c* regards a hopper structure according to the invention specifically used for carrying out the crystallization of amorphous granular polymer material.

In this embodiment, the guide means 18 are designed to make the lower section 5 carry out a composite (rototranslational) movement with respect to the upper section 4, and are formed, for example, by a pair of articulated quadrilateral levers arranged on opposite sides with respect to the hopper 3.

Each articulated quadrilateral lever comprises a main lever arm 21*a* (or 21*b*) that is fitted, as in the embodiment of FIGS. 1*a* to 1*c*, on a horizontal pin, e.g. a horizontal drive shaft 20, of a bracket 20*a* (or 20*b*) fixed to the framework 2 of a secondary lever arm or spring shackle 22*a* (or 22*b*) articulated, at one end thereof, on a pin 23, e.g. supported for rotation in the bracket 20*a* (or 20*b*) and, at the other end thereof, to the end of a rod-like element 30*a* (or 30*b*) (illustrated in the drawing in triangular bracket form), in turn hinged on the opposite side (at 33) to the lower section 5.

It will be noted that the use of articulated parallelogram systems makes possible the moving away-approaching movement of the lower tapered section 5 of the hopper 3 with respect to the upper tubular section 4—first along a predominantly lowering path of the lower section 5 and then with an angular movement towards and between two adjacent uprights 14 of the lower section 5 (FIG. 2*b*). This is particularly advantageous in the cases where a blade carrier shaft 27 is provided for in the hopper 3. In use, such shaft extends inside the lower section 5, and it is necessary to ensure that the lower section in its opening-closing movement does not interfere with the shaft 27.

Figure 3:
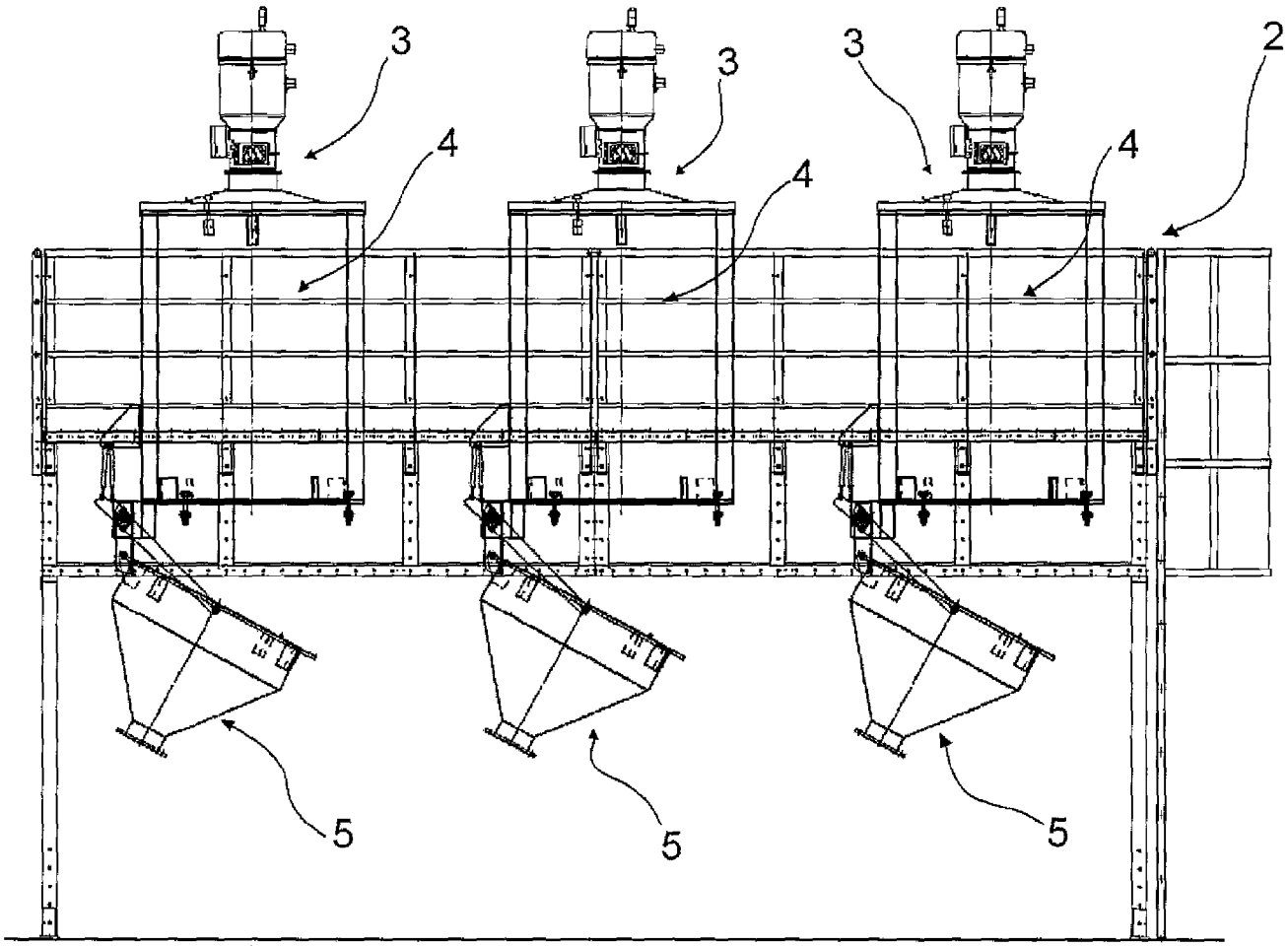
FIG. 3 illustrates a side elevation view with parts in transparency of a dehumidification unit obtained with a set of three hoppers according to the present invention.

Finally, FIG. 3 illustrates a unit for dehumidifying granular material comprising a support structure 2 suitable for supporting three or more hoppers according to the present invention, all illustrated in open position, i.e. having respective lower tapered sections 5 lowered and in any case moved away from the respective upper tubular sections 4. It will be noted that a dehumidification unit of this type allows an easy, convenient maintenance, since it permits an operator to be able to easily carry out cleaning and maintenance operations inside the hoppers.

The hopper structure described above is susceptible to numerous modifications and variations within the protection scope as defined by the following claims.

Thus, for example, the guide means 18 can comprise one or more vertical roll or slide guides, along which at least one transverse support or crossbar can slide, constrained or constrainable to the lower section 5 of the hopper. The movement of the movable equipment comprised of the lower section 5 and the crossbar or crossbars can be carried out manually, e.g. through a reduction gear or pulley system, or automatically, by means of any suitable actuation means, typically a rack device actuated by a reversible motor, one or more fluid-pressure jacks or the like.

In order to avoid heat losses, typically following leaks of drying hot air, the edges (flanged or not) abutting between the upper 4 and lower 5 sections of the hopper 3 are advantageously equipped with at least one seal gasket (not shown in the drawings), thereby ensuring the seal of the work chamber 12 when the lower section 5 is locked in closed position.

The invention claimed is:

1. A hopper structure for heat-treating synthetic granular material, comprising:

an upper tubular section;

a lower tapered section equipped with a discharge mouth for discharging said synthetic granular material after treatment, the lower tapered section being removably connectable to said upper tubular section thereby delimiting, together with said upper tubular section, a containment chamber where the synthetic granular material is loaded for treatment;

a blade carrier shaft extending inside said lower tapered section of said hopper to said discharge mouth;

a support device for at least said upper tubular section; and a guide device supported by said support device at the lower end of said upper tubular section, and configured to guide said lower tapered section while moving between a closed position against said upper tubular section and an open position away from said upper tubular section along a first predominantly lowering path and then an angular movement, in which position the blades of said blade carrier shaft and a zone beneath the upper tubular section is easily accessible by an operator for carrying out maintenance or repair operations.

2. The hopper structure according to claim 1, wherein said guide device comprises at least one lever arm articulated on one side to said support device and on the other side to said lower section, thereby being suitable for carrying out angular moving away-approaching displacements of said lower section with respect to said upper section.

3. The hopper structure according to claim 1, wherein said guide device comprises at least one articulated quadrilateral lever articulated on one side to said support device and on the other side to said lower section, thereby being suitable for carrying out angular moving away-approaching displacements of said lower section with respect to said upper section.

4. The hopper structure according to claim 1, further comprising at least one drive member supported for rotation by said support device and configured to make said at least one lever arm or said at least one articulated quadrilateral lever carry out angular displacements.

5. The hopper structure according to claim 1, wherein said guide device comprises at least one lever arm articulated on one side to said support device and on the other side secured to said lower section.

6. The hopper structure according to claim 1, wherein said guide device comprises at least one lever arm articulated on one side to said support device and on the other side to said lower section.

7. The hopper structure according to 2, wherein said lower section has, in the open position thereof, its longitudinal axis tilted.

8. The hopper structure according to claim 2, wherein said lower section has, in the open position thereof, its longitudinal axis substantially parallel with that of said upper section.

9. The hopper structure according to claim 2, wherein said guide device comprises a resilient load unit suitable for stabilizing the moving away-approaching movement of said lower tapered section with respect to said upper section.

10. The hopper structure according to claim 9, wherein said resilient load unit comprises at least one gas spring.

11. The hopper structure according to claim 2, wherein said guide device comprises at least one vertical roll or slide guide member, along which at least one support element can slide which is constrainable to said lower section, whereby said lower section, in the open position thereof, has its own longitudinal axis substantially vertical.

12. The hopper structure according to claim 2, further comprises an actuation device for controlling the movement of said lower section between its closed position and its open position.

13. The hopper structure according to claim 12, wherein said actuation device comprises at least one manual control device.

14. The hopper structure according to claim 12, wherein said actuation device comprises at least one automatic control device.

15. The hopper structure according to claim 2, wherein said support device comprises at least three upright elements.

16. The hopper structure according to 2, wherein said upper section is secured to said support device by means of bracket elements.

17. The hopper structure according to 1, further comprising a closed-position locking device for said lower section against said upper section.

18. The hopper structure according to claim 17, wherein said locking device comprises a plurality of clamps.

19. A synthetic granular material heat-treatment unit according to claim 1, further comprising a plurality of hoppers supported by said support device.

* * * * *